US011833544B2

(12) United States Patent
Bailey

(10) Patent No.: US 11,833,544 B2
(45) Date of Patent: Dec. 5, 2023

(54) SHALE SHAKER BASKET SYSTEM

(71) Applicant: Axiom Process Limited, Newcastle Upon Tyne (GB)

(72) Inventor: Marshall Graham Bailey, Dubai (AE)

(73) Assignee: Grant Prideco, Inc., Houston, TX (US)

( * ) Notice: Subject to any disclaimer, the term of this patent is extended or adjusted under 35 U.S.C. 154(b) by 1176 days.

(21) Appl. No.: 16/469,754

(22) PCT Filed: Dec. 14, 2017

(86) PCT No.: PCT/GB2017/053744

§ 371 (c)(1),
(2) Date: Jun. 14, 2019

(87) PCT Pub. No.: WO2018/109478

PCT Pub. Date: Jun. 21, 2018

(65) Prior Publication Data

US 2019/0321857 A1 Oct. 24, 2019

(30) Foreign Application Priority Data

Dec. 14, 2016 (GB) ..... 1621279

(51) Int. Cl.
*B07B 1/46* (2006.01)
*B07B 1/36* (2006.01)
*B07B 13/16* (2006.01)

(52) U.S. Cl.
CPC ..... *B07B 1/4609* (2013.01); *B07B 1/36* (2013.01); *B07B 13/16* (2013.01);
(Continued)

(58) Field of Classification Search
CPC ..... B07B 1/36; B07B 1/4609; B07B 2201/02; B07B 2201/04; B07B 2230/01; B07B 13/16
See application file for complete search history.

(56) References Cited

U.S. PATENT DOCUMENTS 4,882,054 A * 11/1989 Derrick ..... B01D 33/802 210/405
6,431,366 B2 * 8/2002 Fallon ..... B07B 1/46 209/314

(Continued)

FOREIGN PATENT DOCUMENTS

AU 2017374784 B2 6/2018
GB 2486847 6/2012

(Continued)

OTHER PUBLICATIONS

International Search Report and Written Opinion for PCT/GB2017/053744 dated Mar. 15, 2018 (16 pages).

(Continued)

*Primary Examiner* — Terrell H Matthews
(74) *Attorney, Agent, or Firm* — Conley Rose, P.C.

(57) ABSTRACT

A basket system for a shale shaker includes a front, solids discharge end and a rear, feed end, spaced apart by opposed first and second sides. The feed end includes a fluid retaining wall. A first screen deck frame is mounted or mountable to the basket for supporting a screening surface and forming a first screen deck in use. The screening surface of the first screen deck has a lower, feed receiving end that is proximal to the fluid retaining wall at the rear end of the basket and a distal, higher, solids discharge end at the front end of the basket. The basket further includes at least one mounting for mounting at least one additional screen deck frame above or below the first screen deck frame.

13 Claims, 5 Drawing Sheets

(52) U.S. Cl.
CPC ..... *B07B 2201/02* (2013.01); *B07B 2201/04* (2013.01); *B07B 2230/01* (2013.01)

(56) References Cited

U.S. PATENT DOCUMENTS

| | | | | |
|---|---|---|---|---|
| 2003/0201237 | A1* | 10/2003 | Grichar | B07B 1/46 210/384 |
| 2007/0131592 | A1* | 6/2007 | Browne | B07B 1/46 209/405 |
| 2010/0089802 | A1* | 4/2010 | Burnett | B07B 1/46 209/660 |
| 2010/0270216 | A1* | 10/2010 | Burnett | B01D 33/0376 209/606 |
| 2016/0356108 | A1* | 12/2016 | Kutryk | B01D 33/03 |

FOREIGN PATENT DOCUMENTS

| | | |
|---|---|---|
| WO | 2009096798 | 8/2009 |
| WO | 2012160259 | 11/2012 |
| WO | 2013030667 | 3/2013 |
| WO | 2015166282 | 11/2015 |

OTHER PUBLICATIONS

MX Office Action dated May 24, 2023 for Patent Application No. MX/a/2019/006947.

* cited by examiner

SHALE SHAKER BASKET SYSTEM

CROSS REFERENCE TO RELATED APPLICATIONS

This application is a 35 U.S.C. § 371 national stage application of PCT/GB2017/053744 filed Dec. 14, 2017 and entitled "Shale Shaker Basket System", which claims priority to United Kingdom Patent Application No. 1621279.7 filed Dec. 14, 2016, each of which is incorporated herein by reference in their entirety for all purposes.

STATEMENT REGARDING FEDERALLY SPONSORED RESEARCH OR DEVELOPMENT

Not Applicable

FIELD OF THE DISCLOSURE

This disclosure relates to screening arrangements used in shale shakers as used for example for separating drill cuttings from used drilling mud when drilling operations such as drilling an oil well are being carried out.

BACKGROUND

Screening machines, especially vibratory screening machines such as the so called 'shale shakers' of the oil well drilling industry are used with success in methods of solids/liquids separation, especially classification.

Different designs of shale shaker are employed depending on the duty required for a drilling operation. Single deck shale shakers, having a single screening surface in the vibratory basket are employed to remove solids from a used drilling mud in a single screening (filtering) stage.

Multi-deck shale shakers having two three or more screen decks, stacked one above the other, can be used for progressive screening; passing a mixture such as a used drilling mud down through screening surfaces of successively finer cut to efficiently remove solids of different particle size. Such multi deck shale shakers can also be used to carry out higher throughput screening when employed in a parallel mode, by dividing the feed (or the feed after one or more initial screening steps on an upper screening surface) into two or more steams each of which are directed to different decks in the stack for screening.

An earlier patent application (WO2015/166282) of the inventor of this application describes a shale shaker that includes a basket mounting at least two, typically three, screen decks that are closely spaced together one above the other. Each deck has a screening surface for screening a solids and liquid feed (normally used drilling mud and drill cuttings). The described machine is used for a screening method with the feed receiving end of each screening surface in the stack of two or three screen decks submerged in a common pond of applied solids and liquid feed.

The entire contents of WO2015/166282 are incorporated by reference herein. The shale shaker and method described in that application provide notable improvements in compactness of design and improved throughput for a feed that is to be successively screened through at least the two or three screen decks in the stack provided in the basket. A number of optional features are described to facilitate screening operations and/or to allow operations under different conditions such as a change in feed character or the desire to collect solids from different screening surfaces separately to allow recycling of solids of preferred physical characteristics to a drilling mud.

More generally shale shaker design is selected on the basis of economy and efficiency for the anticipated task. A single deck machine finds use where the screening operation is relatively simple and a lower cost but less efficient operation is acceptable. Multi-deck machines find use where screening is more difficult and/or higher throughput is required and/or solids of a selected size range are to be recovered for re-use in a drilling mud.

Whilst shale shakers of different types are available there remains the desire to improve efficiency and utility further.

SUMMARY OF THE DISCLOSURE

In a first aspect, the present disclosure provides a basket system for a shale shaker, wherein the basket comprises:

- a front, solids discharge end and a rear, feed end, spaced apart by opposed first and second sides, wherein the feed end includes a fluid retaining wall;
- a first screen deck frame mounted or mountable to the basket for supporting a screening surface and forming a first screen deck in use, whereby the screening surface of the first screen deck has a lower, feed receiving end that is proximal to the fluid retaining wall at the rear end of the basket and a distal, higher, solids discharge end at the front end of the basket; and
- wherein the basket further includes at least one mounting for mounting at least one additional screen deck frame above or below the first screen deck frame.

An additional screen deck frame or screen deck frames can support an additional screening surface or additional screening surfaces, thereby forming one or more additional screen decks above or below the first screen deck i.e. a multi deck screening basket can be formed.

Conveniently, the first screen deck may be below the mounting or mountings for additional screen decks i.e. the first screen deck is a lower or even the lowest screen deck that is fitted to the basket. In this arrangement additional screen decks are fitted above the first screen deck in respective mountings. Such mountings may be easier to access when upgrading the single deck basket to a two, three or even more multi-deck basket.

To allow construction of second, third etc. screen decks the basket system may be provided with further screen deck frames, or they may be supplied to a user of the system when needed.

The mounting or mountings may be formed and arranged so that an additional screen deck or additional screen decks fitted to the basket may each have respective screening surfaces with a lower, feed receiving, end that is proximal to the fluid retaining wall at the rear end of the basket and a distal, higher, solids discharge end at the front end of the basket. Alternatively, in some cases, one or more screen decks may have a screening surface that is at a different angle e.g. horizontal.

Conveniently the fluid retaining wall is an end wall of the basket. Typically the basket will have a fluid retaining end wall at the rear feed end and two side walls forming the opposed first and second sides. The front, solids discharge end of the basket of the basket may be open for discharge of the solids collected by screening surfaces in the conventional way.

The basket system includes a first screen deck frame mounted or mountable to the basket. The first screen deck frame may be permanently mounted to the basket, for example welded into place. The basket is for a shale shaker that can operate as a single deck or a multi-deck shale shaker. Therefore the first screen deck frame can be employed for conventional single deck shale shaker operations and as one deck, together with one or more further decks, in multi-deck screen operations.

The first screen deck frame for the first screen deck and the additional screen deck frames described herein may each comprise more than one frame unit. The frame units may connect together (e.g. by bolts or by welding) or are at least held in position to form the complete screen deck frame for the respective screen deck.

The mountings for mounting screen deck frames (first or additional) may be formed in different ways.

For example, the mounting may include one or more flanges projecting from the rear of the basket, typically from the fluid retaining wall, towards the front end of the basket. A screen deck frame may be fitted with releasable fastenings such as bolts for connection to a flange and/or to other features in the basket. The flanges may project towards the front end of the basket and be downwards directed, providing a downwards directed surface, to which a front edge of the screen deck frame may be connected to, typically by bolts or other similar fixings. The flanges may themselves mount by fixings such as bolts to the fluid retaining wall. When not employed, bolt holes may be blanked off in the known manner.

The screen deck frame and the flange may be in substantially sealing engagement or in sealing engagement, for example by use of suitable resilient seals between them.

The use of such flanges allows spacing of the feed end of each screen deck, away from the fluid retaining wall. Advantageously where one or more additional screen deck frames are fitted, the feed receiving end of each screen deck frame may be spaced further away from the fluid retaining wall than the screen deck frame below. For example if the first screen deck is the lowest and second and third screen decks are provided above (with the third above the second), then the feed receiving end of the first screen deck will be closest to the fluid retaining wall. The feed receiving end of the second screen deck will be further away from the fluid retaining wall and the feed receiving end of the third screen deck will be furthest away from the fluid retaining wall.

Such a staggered arrangement of the feed ends of the screen deck frames is advantageous in allowing a corresponding stagger at the solids discharge ends of the screen decks, when standard length screen decks are employed. The arrangement can allow separate collection of the solids discharged from one screen deck or even from each screen deck. This can be useful where solids of a selected size range are to be recovered, for example for recycling.

Other mountings for a screen deck frame in the basket may include flanges running along the sides of the basket ('runners') on which a screen deck frame may sit, and may be bolted or otherwise releasably fixed in place. As well as the (supporting) flanges on which the frame edges sit, mountings may include upper flanges, generally parallel and above the supporting flanges. Thus frame edges can locate between a pair of flanges that form a slot, along a length of the basket side.

Alternatively fixing may be more directly to the side of the basket, for example by bolts in holes provided on the basket sides.

Advantageously the feed (solids and liquid comprising drilling mud and drill cuttings) for a shale shaker may be directed on to the screening surface at the feed end via a conduit or chute that discharges the feed close to the screening surface. Typically discharge is in a direction generally towards the rear of the basket (i.e. generally towards the fluid retaining wall). These features can allow a less turbulent, controlled flow at the feed end, reducing wear, especially on screening surfaces. The applied feed returns from the fluid retaining wall in the direction of the front of the basket. Furthermore the use of flanges projecting from the rear of the basket, typically from the fluid retaining wall as discussed above, can allow at least part of the feed to be directed first onto the flange, from where it flows forwards onto the actual screening surface of the respective screen deck for processing. Thus the preferred location of the feed distribution end of a feed conduit can change, depending on the number of screen decks fitted to a basket.

For example, where only one lower screen deck is fitted the feed distribution end of the feed conduit may be lower in the basket and closer to the fluid retaining wall. Where two or three screen decks are fitted in a basket then the feed distribution end of the feed conduit may be higher in the basket. If such a multi deck arrangement is in use, the feed ends of the screen deck frames of respective screen decks may be staggered, for example by the use of flanges projecting from the rear of the basket. In which case, the feed distribution end of the feed conduit may desirably be further forwards in the basket, as well as higher in the basket.

Thus, the basket system of the disclosure may include an adjustable feed conduit, adjustable to suit the location of the feed end of the uppermost screen deck in use in the basket.

Adjustment may be by providing different length extension pieces for a feed conduit. Conveniently the extension pieces are end pieces of the conduit to direct the feed close to a screen deck. Alternatively adjustment may be by having a telescopic feed conduit e.g. having nested tubular parts that slide one within another.

Screening surfaces are supported on the screen deck support frames in the usual way and may be held in the basket and tensioned in the known manner. For example the screening surfaces may be pretensioned wire screen meshes on apertured plates. The apertured plates sit on the screen deck frames and be tensioned and clamped into place, for example by use of screen deck runners or rails along the sides of the basket which incorporate an inflatable bladder system to clamp and tension the screening surface to the basket and to the corresponding screen deck frame.

The basket will be fitted with a vibratory drive system. The drive system may employ rotating eccentric weights, in the known manner. Typically the vibratory motor system is fitted to bridge across the basket from one side to the other. Alternatively the basket may be fitted with a vibratory drive system that applies vibratory motion more or less directly to sides of the basket.

Conveniently, the vibratory drive system is sized to have sufficient size and strength for the highest loading conditions. This can avoid a requirement to replace the whole vibratory drive arrangement when the basket is upgraded for multi-deck screening purposes. For example, for when the basket is fitted with three screen decks. As more decks are fitted to the basket the strength and direction of the vibratory motion required may change. For this reason the vibratory drive may be fitted with different eccentric weights and/or the position of the rotating eccentric weights may be adjustable in use of the shale shaker basket.

The basket systems of the disclosure allows upgrading of the basket from that of a conventional or substantially conventional single deck shale shaker to a multi deck machine that may include recovery of sized solids and may be capable of series or parallel operation. The basket may be fitted out with conventional multi-deck arrangements, for example two or more screen decks that may have flow directing trays (flow back pans) between each deck to direct the filtrates back towards the feed receiving end of the basket in the usual way. If flow directing trays are an option contemplated with a basket of the disclosure then trays may bolt to the sides of the basket or to flanges mounted to the sides of the basket.

Alternatively the basket may be operable in a compact multi-deck machine of the general type described in the inventor's co-pending WO2015166282. In such a machine the basket can mount close together screen decks, for example with a spacing of from 20 mm to 120 mm, at their feed receiving ends.

The basket of the basket system may further comprise solids recovery chutes as required for normal operation as a shale shaker and/or for directing solids of selected size range to a desired location for reuse.

Thus the basket system described herein can provide a single deck shale shaker that can be upgradeable to a multi deck machine with simple fitting and/or removal and exchange of components (i.e. the shaker can be upgradable at a location in the field or in an unsophisticated workshop). The basket of the basket system may thus be field upgradeable.

A second aspect the present disclosure provides a shale shaker comprising a basket system as described herein. The shale shaker fitted with the basket system may be field upgradeable. The shale shaker will further comprise the usual components as required, such as a base, resilient mountings for the basket to the base, feed and discharge arrangements.

Thus the shale shaker may find use for basic shale shaker operations when operating with a single deck.

When one upper deck is fitted benefits of this two deck arrangement can include increased solids removal efficiency with the upper deck screen removing larger solids and the lower deck finer solids. This results in increased capacity, solids removal efficiency and improved screen life on lower fine screening surfaces.

When operated with two or more upper decks in the stack of screen decks. e.g. with two upper decks and the lower deck to form a triple deck machine the benefits possible include increased solids removal efficiency with the upper deck screen removing larger solids and the lower decks progressively removing finer solids—resulting in increased capacity, solids removal efficiency and improved screen life on lower fine screens. In addition opportunity to carry out recovery or recycle of solids of a selected size range, depending on the screen mesh size and types employed.

In a third aspect, the present disclosure provides a basket system for a shale shaker, wherein the basket comprises:

a front, solids discharge end and a rear, feed end, spaced apart by opposed first and second sides, wherein the feed end includes a fluid retaining wall;

a lower screen deck frame mounted or mountable to the basket for supporting a lower screening surface and forming a lower screen deck in use, whereby the screening surface of the lower screen deck has a lower, feed receiving, end that is proximal to the fluid retaining wall at the rear end of the basket and a distal, higher, solids discharge end at the front end of the basket;

wherein the fluid retaining wall includes a feed director extending rearwards and formed for directing an applied solids and liquid feed towards the front of the basket and onto the lower screen deck; and wherein the basket further includes a mounting for mounting at least one upper screen deck frame above the lower screen deck frame; and a mounting for a cover plate releasably attachable to the fluid retaining wall to cover the location for the feed director on the fluid retaining wall; and wherein the system further includes at least one upper screen deck frame and at least one cover plate; the cover plate comprising a mounting for mounting at least one upper screen deck frame above the lower screen deck frame.

The provision of the feed director extending rearwards can allow a generally shorted basket in comparison with a basket system of the first aspect that does not include such a provision. This can be advantageous where space is at a premium.

Unless otherwise specified, features discussed above with respect to the first aspect may also be employed with a basket system of the third aspect. Similarly the features described herein with respect to the third aspect may be employed with a basket system according to the first aspect. The basket system of the third aspect may also be employed in a shale shaker according to the second aspect.

The feed director of the fluid retaining wall may be a rearwards extending deviation or bulge in the shape of the fluid retaining wall. The bulge is formed and arranged so that a solids and liquid feed, such as a used drilling mud, directed into the bulge is deflected and returned forwards onto the screening surface of the lower screen deck. For example, a fluid retaining wall, typically generally vertically aligned, may include a rearwards extending bulge that returns to the general upright plane of the fluid retaining wall, at or close to the feed receiving end of the lower screen deck.

Conveniently the fluid retaining wall may be provided with an aperture for mounting or an aperture mounting the feed director. With this arrangement, the feed director extends rearwards of the aperture. A solids and liquids feed applied into the aperture of the fluid retaining wall is directed towards the front of the basket and onto the lower screen deck. The cover plate when used may cover the aperture, which is the location for the feed director i.e. the cover plate and its mounting are formed and arranged so that the cover plate covers the aperture in use.

Thus exemplary embodiments disclosed herein also provide, in accordance with the third aspect, a basket system for a shale shaker, wherein the basket comprises:

a front, solids discharge end and a rear, feed end, spaced apart by opposed first and second sides, wherein the feed end includes a fluid retaining wall;

a lower screen deck frame mounted or mountable to the basket for supporting a lower screening surface and forming a lower screen deck in use, whereby the screening surface of the lower screen deck has a lower, feed receiving, end that is proximal to the fluid retaining wall at the rear end of the basket and a distal, higher, solids discharge end at the front end of the basket;

wherein the fluid retaining wall includes a feed director and an aperture for mounting, or an aperture mounting the feed director; the feed director when mounted extending rearwards of the aperture and formed for directing a solids and liquid feed applied into the aperture towards the front of the basket and onto the lower screen deck; and wherein the basket further includes a mounting for mounting at least one upper screen deck frame above the lower screen deck frame; and a mounting for a cover plate releasably attachable to the fluid retaining wall to cover the aperture; and wherein the system further includes; at least one upper screen deck frame and at least one cover plate; the cover plate comprising a mounting for mounting at least one upper screen deck frame above the lower screen deck frame.

The basket systems according to the third aspect may be provided without parts such as additional screen deck frames (for one or more upper screen decks) or the cover plate, when for use as single deck. Such items can be supplied to a user when upgrading the basket to multi deck use is required.

Conveniently, the fluid retaining wall is an end wall of the basket. Typically the basket will have a fluid retaining end wall at the rear feed end and two side walls forming the opposed first and second sides. The front, solids discharge end of the basket of the basket may be open for discharge of the solids collected by screening surfaces in the conventional way.

The basket includes a lower screen deck frame mounted or mountable to the basket. The lower screen deck frame may be permanently mounted to the basket, for example welded into place. The basket is for a shale shaker that can operate as a single deck or a multi-deck shale shaker, therefore the lower screen deck frame can be employed for conventional single deck shale shaker operations and as the lower deck in multi-deck screen operations.

The lower screen deck frame and the upper screen deck frames described herein may comprise more than one frame unit. The frame units may connect together (e.g. by bolts or by welding) or are at least held in position to form the complete screen deck frame for the respective screen deck.

The fluid retaining wall may include an aperture for mounting, or an aperture mounting the feed director of the fluid retaining wall. The feed director may be permanently fixed in place. For example by welding, or may be releasably attached to the fluid retaining wall, for example by bolts. A releasably attachable feed director has the advantage that other equipment that extends rearwards of the fluid retaining wall may be attached, e.g. to make use of the aperture as a flow route. For example, a flow distributor that takes filtrate from an upper screen deck and delivers it to one or more lower screening surfaces.

The feed director may take different forms. When the fluid retaining wall includes an aperture, the feed director extends rearwards of the aperture in the fluid retaining wall. The feed director may be a deflector plate or trough that receives a solids and liquid feed from outside (rearwards of) the rear wall of the basket and directs the feed forwards through the aperture towards the lower screen deck. However, the basket is part of a shale shaker can be modified. Such a feed arrangement may require significant alteration of the feed arrangements to the basket when the shaker is converted to a multi-deck use.

Conveniently, the feed director takes the form of a blister on the aperture of the fluid retaining wall. The blister may seal to around the periphery of the aperture, which may be generally rectangular in form. The blister extends (bulges) rearwards of the fluid retaining wall. A solids and liquid feed can then be directed from forwards of the fluid retaining wall, rearwards into the aperture where it is then returned forwards from the inside surface of the blister towards the lower screen deck. With such an arrangement, where feed is supplied into the basket and directed rearwards into the aperture the feed delivery chute or other feed arrangement employed can remain in essentially the same location when the basket is upgraded for multi-deck use.

The cover plate comprises a mounting for mounting at least one upper screen deck frame above the lower screen deck frame. A cover plate may comprise mountings for mounting two or more upper screen deck frames, one above the other, to form a stack of screen deck frames above the lower screen deck frame.

For example, the cover plate may include one or more flanges projecting towards the front end of the basket to which a screen deck frame may be fitted with releasable fastenings such as bolts. The flanges may project towards the front end of the basket and be downwards directed, providing a downwards directed surface, to which a front edge of the screen deck frame may be connected to, typically by bolts or other similar fixings.

The screen deck frame and the flange may be in substantially sealing engagement or in sealing engagement, for example by use of suitable resilient seals between them.

The use of such flanges on the cover plate allows spacing of the feed end of each upper screen deck, away from the fluid retaining wall. Advantageously where one upper screen deck frame is fitted a flange is employed to space its feed end further away from the fluid retaining wall than the feed end of the lower screen frame. Where two or more upper screen deck frames are fitted, the feed receiving end of each screen deck frame may be spaced further away from the fluid retaining wall than the screen deck frame below.

Such a staggered arrangement of the feed ends of the screen deck frames is advantageous in allowing a corresponding stagger at the solids discharge ends of the screen decks, when standard length screen decks are employed. The arrangement can allow separate collection of the solids discharged from one screen deck or even from each screen deck. This can be useful where solids of a selected size range are to be recovered, for example for recycling.

The cover plate is releasably attachable to the fluid retaining wall to cover the location of the feed director, which may be the aperture for mounting or the aperture mounting the feed director. Attachment may be by bolts. Where the cover plate includes one or more flanges projecting towards the front end of the basket the flanges of the cover plate may be secured to the sides of the basket, for example by releasable attachment to cover plate support flanges provided on the sides of the basket.

The screen deck support frames may be arcuate in form to result in 'crown deck' screening surfaces of the known type.

DETAILED DESCRIPTION OF DISCLOSED EXEMPLARY EMBODIMENTS

Figure 1:
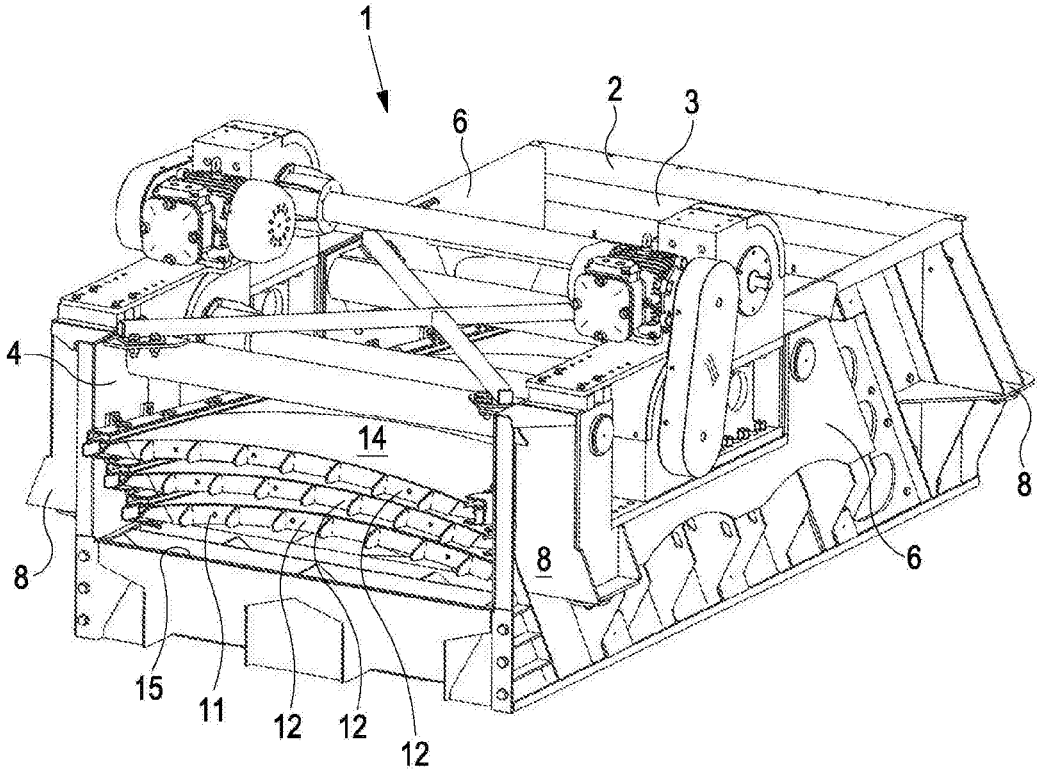
FIG. 1 shows a multi deck shaker.

FIG. 1 shows a prior art shale shaker basket 1 of the same type shown in WO2015/166282. The basket 1 has a rear, feed end 2 with a fluid retaining wall 3 that is the rear end of the basket. The front, solids discharge end of the basket 4 is spaced from the feed end 2 by sides 6. The basket has mounts 8 for springs (not shown) to allow the basket 1 to float on a base (also not shown) when driven by vibratory drive system 10.

Visible at the front end of the basket is a stack of three closely spaced screen decks 11 including screen deck frames 12 and screening surfaces 14. Solids falling from the ends of screen decks 11 can be collected and distributed as desired via trough arrangement 15

Figure 2A:
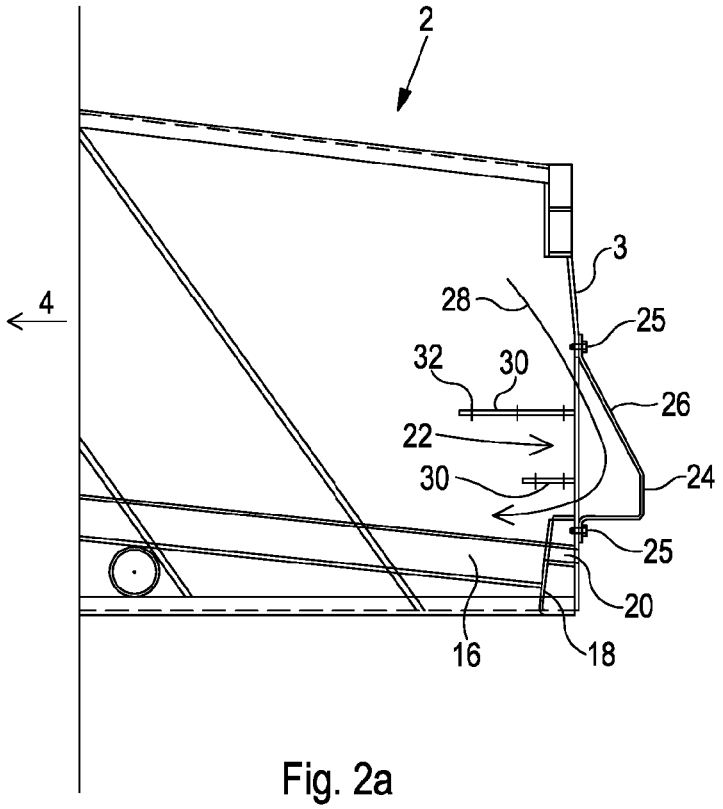
FIG. 2*a* shows in schematic partial cross section the feed end of a shale shaker basket.
Figure 2B:
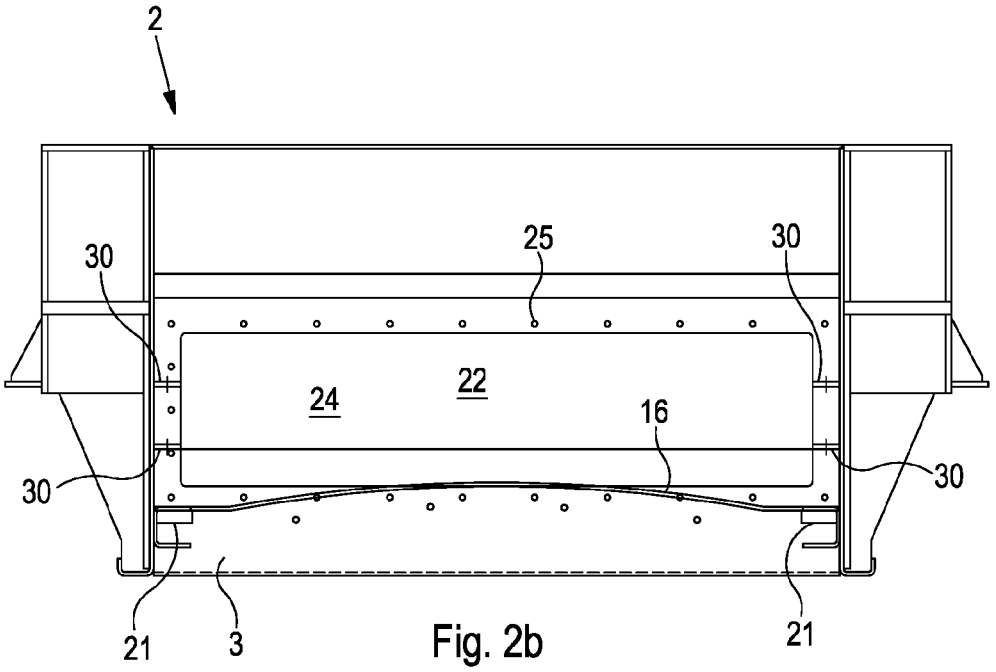
FIG. 2*b* shows in schematic elevation the end of a shale shaker basket feed viewed from inside the basket.

FIGS. 2*a* and 2*b* show in partial cross section and elevation the rear feed end 2 of a basket generally of the form shown in FIG. 1 but modified to be a basket system of the third aspect of the disclosure.

As can be seen in FIG. 2, a lower screen deck frame 16 which mounts a screening surface in use is fixed to a flange 18 of the fluid retaining wall 3. This may be by bolts at 20 or by welding. The lower screen deck frame 16 is also fitted to rest and be secured to flanges 21 of the basket sides as can be seen in FIG. 2*b*, where the arcuate upper surface of the screen deck frame 16 can be seen. Frame members supporting or making up the arcuate surface in the conventional way are not shown in this figure for clarity. The lower screen deck frame 16 is angled upwards towards the solids discharge end 4 of the basket.

The fluid retaining wall 3 that forms the rear wall of the basket in this example is provided with rectangular aperture 22. Fitted at aperture 22 is a feed director 24 in the form of a blister 26. Feed director 24 is fixed by bolts 25 in this example and so is releasably attached. As an alternative it could be welded in place. As suggested by arrow 28, a solids and liquid feed applied rearwards to aperture 22 will be deflected and returned forwards onto the screening surface of the lower screen deck (frame 16 and an associated screening surface). This action moderates the flow of feed onto the lower screen deck, providing improved screening and reducing wear on the screening surface.

Also visible in FIGS. 2*a* and 2*b* are cover plate support flanges 30 for supporting cover plates as described below with reference to FIGS. 2*d* and 2*e*. The cover plate support flanges 30 have the location of their bolt holes indicated in these figures by short vertical lines 32.

Figure 2C:
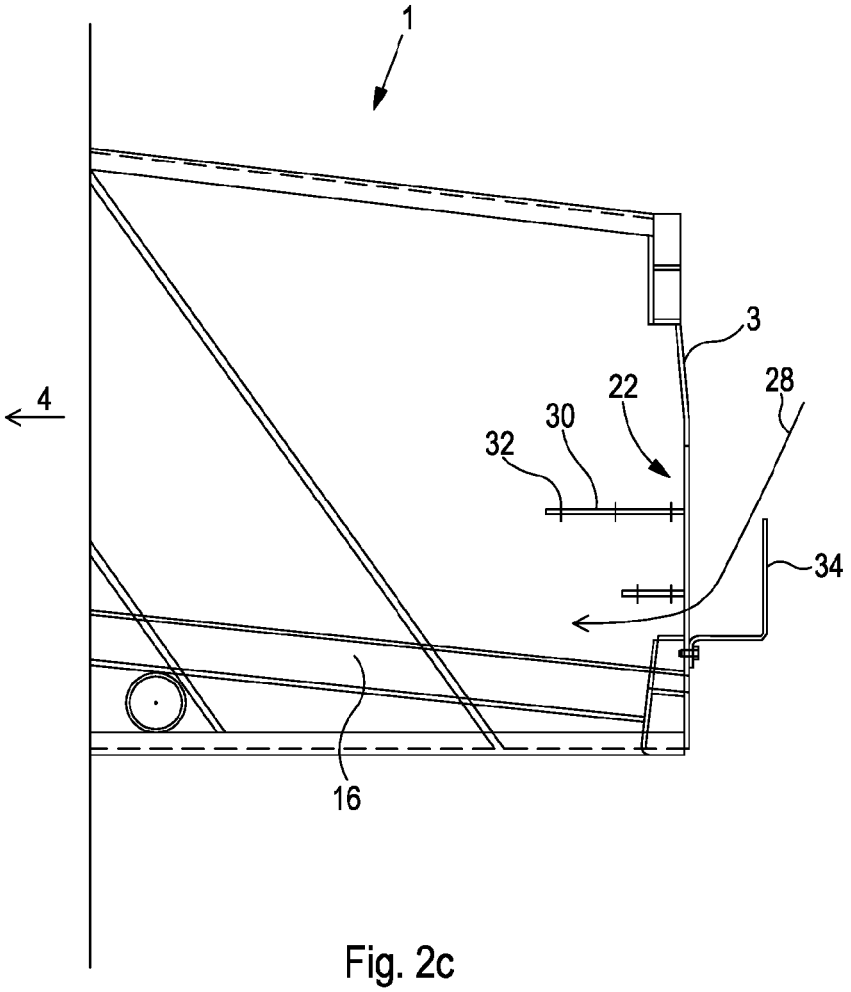
FIGS. 2*c* to 2*e* each show in schematic partial cross section the feed ends of a shale shaker basket.

FIG. 2*c* shows a similar arrangement to that of FIG. 2*a* except that feed director is in the form of a trough 34 for directing a solids and liquids feed into the basket 1 from outside the fluid retaining wall 3, through aperture 22 and forwards to the lower screen deck as suggested by arrow 28.

Figure 2D:
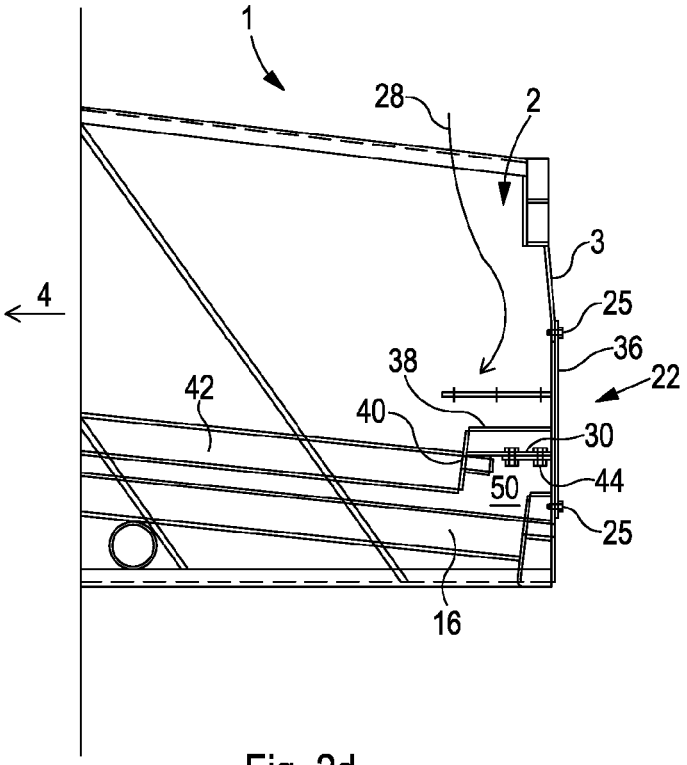

In FIG. 2*d*, a similar arrangement to that of FIG. 2*a* is shown except that the feed director has been removed and the aperture 22 is covered by cover plate 36. In this example the cover plate 36 is conveniently fitted to the outside of aperture 22, and may be mounted to the same bolt holes as used for the feed director. The feed director of FIGS. 2*a* and 2*b* could be left in place, instead of being removed. The feed director may be permanently welded in place. If so a similar plate could be fitted to the inside of the aperture 22 to cover it.

Cover plate 36 mounts flange 38 projecting forwards and downwards to provide a mounting 40 for bolting on an upper screen deck frame 42 that sits above lower screen deck frame 16 and has an extreme end further away from the rear end of the basket 1 (fluid retaining wall 3) than the lower screen frame 16. Cover plate support flanges 30 support cover plate flange 38 and secure it by bolts 44.

In this example the two screen deck frames 16 and 42 are close together, so as to allow operation of the feed ends of the inclined screen decks in a common pond formed from an applied feed 28, in the manner described in WO2015/166282. In other examples screen decks may be spaced further apart to allow conventional multi deck shale shaker operations, including operating with flow directing trays between the screen decks.

Figure 2E:
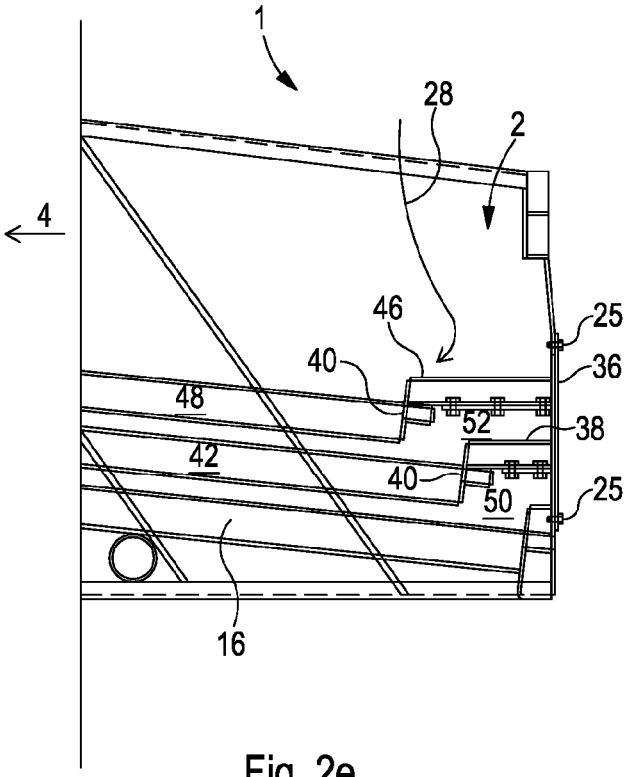

In FIG. 2*e*, similar to FIG. 2*d*, cover plate 36 mounts two flanges 38, 46 projecting forwards and downwards to provide mountings 40 for bolting on a respective upper screen deck frame 42, 48. The three screen deck frames 16, 42 and 48 are staggered by the use of the flanges 38, 46 so that the feed receiving end of each screen deck frame is spaced further away from the fluid retaining wall 3 than the screen deck frame below. Where same length screen deck frames are employed this results in a corresponding stagger at the solids discharge end 4 of the basket 1, like that visible in the basket shown in FIG. 1.

In this example, the three screen deck frames 16, 42 and 48 are close together, in the manner described in WO2015/166282 so as to allow operation of the feed ends of the inclined screen decks in a common pond formed from an applied feed 28.

The flanges 38 (in FIG. 2*d*) and 46 (in FIG. 2*e*) also serve to deflect an applied solids and liquid feed 28 forwards onto the uppermost screening surface.

In the arrangement depicted in FIGS. 2*d* and 2*e* there is a cavity or headspace 50, 52 formed above the screen deck below by the use of flanges 38 and 46. The cavity extends to higher than the extreme end of the screening surface of the screen deck above. This has been shown to provide benefits in terms of avoiding blockages and reduced screen wear in operation of a machine with closely spaced screen decks.

Figure 3A:
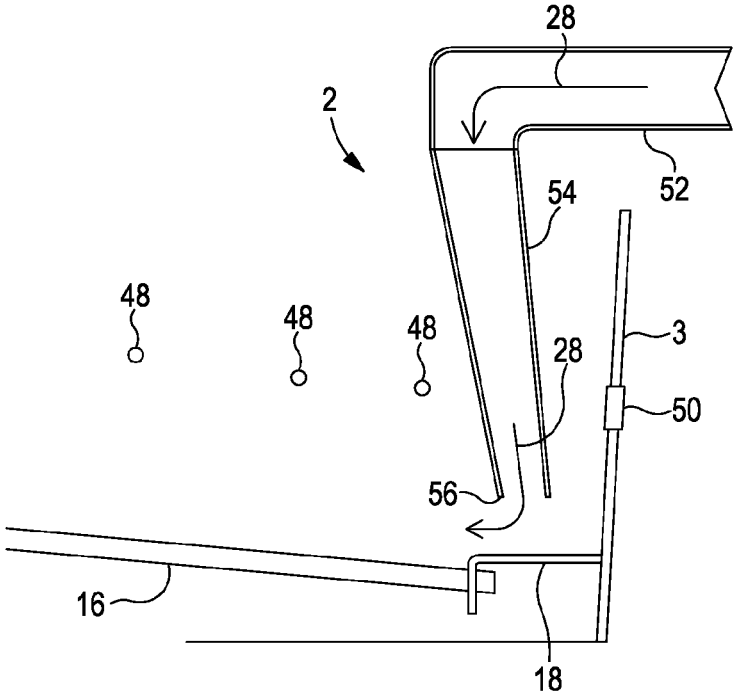
FIGS. 3*a* and 3*b* each show in schematic partial cross section the feed ends of a shale shaker basket.
Figure 3B:
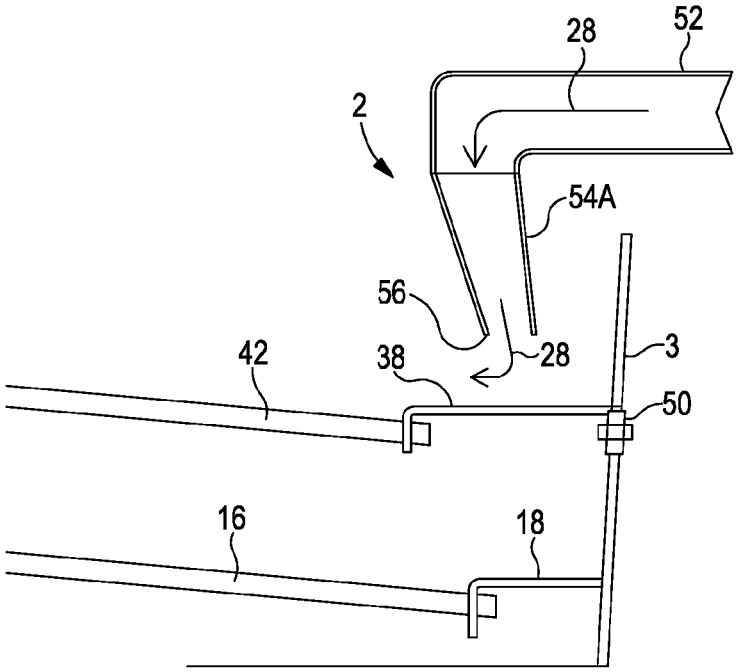

FIGS. 3*a* and 3*b* each show in partial schematic cross section and elevation the rear feed end 2 of a basket generally of the form shown in FIG. 1 but modified to be a basket system of the first aspect of the disclosure.

In FIG. 3*a*, a first (lower in this example) screen deck frame 16, which mounts a screening surface in use, is fixed to a flange 18 of the fluid retaining wall 3. Also visible in this view is a mount for a second screen deck that includes covered bolt holes 48 along the side of the basket and covered or plugged fixing hole(s) 50 for mounting a flange as discussed below with respect to FIG. 3*b*. A feed conduit 52 directs a feed suggested by arrows 28 down through a replaceable feed distribution end 54 in a direction towards the fluid retaining wall 3 and flange 18. The extreme end 56 of feed distribution end 54 is close to flange 18. Flow 28 turns from the direction of wall 3 back across flange 18 for processing on the screen deck.

In FIG. 3*b*, in addition to first (lower) screen deck frame 16 an additional screen deck frame 42 is fitted to convert the basket into a two deck arrangement. Frame 42 is mounted by means of holes 48 (FIG. 3*a*) and fixing to flange 38. A feed conduit 52 directs a feed suggested by arrows 28 down through a replaceable feed distribution end 54A, shorter than that employed in FIG. 3*a*, in a direction towards the fluid retaining wall and flange 38. The extreme end 56 of feed distribution end 54A is close to flange 28. Flow 28 turns from the direction of wall 3 back across flange 38 for processing on the screen deck.

The invention claimed is:

1. A basket system for a shale shaker, wherein the basket comprises:

a front, solids discharge end and a rear, feed end, spaced apart by opposed first and second sides, wherein the feed end includes a fluid retaining wall;

a lower screen deck frame mounted or mountable to the basket for supporting a lower screening surface and forming a lower screen deck in use, whereby the screening surface of the lower screen deck has a lower, feed receiving, end that is proximal to the fluid retaining wall at the rear end of the basket and a distal, higher, solids discharge end at the front end of the basket;

wherein the fluid retaining wall includes a feed director extending rearwards and formed for directing an applied solids and liquid feed towards the front of the basket and onto the lower screen deck; and wherein the basket further includes a mounting for mounting at least one upper screen deck frame above the lower screen deck frame; and a mounting for a cover plate releasably attachable to the fluid retaining wall to cover the location for the feed director on the fluid retaining wall; and wherein the system further includes at least one upper screen deck frame and at least one cover plate; the cover plate comprises a mounting for mounting at least one upper screen deck frame above the lower screen deck frame.

2. The basket system of claim 1 wherein the fluid retaining wall is provided with an aperture for mounting or an aperture mounting the feed director; the feed director when mounted extending rearwards of the aperture and formed for directing a solids and liquid feed applied into the aperture towards the front of the basket and onto the lower screen deck.

3. The basket system of claim 2 wherein the feed director takes the form of a blister on the aperture of the fluid retaining wall.

4. The basket system of claim 3 wherein the blister seals to around the periphery of the aperture.

5. The basket system of claim 2 wherein the feed director is a deflector plate or trough that receives a solids and liquid feed from outside the rear wall of the basket and directs the feed forwards through the aperture towards the lower screen deck.

6. The basket system of claim 2 wherein the feed director of the fluid retaining wall is a rearwards extending deviation or bulge in the shape of the fluid retaining wall.

7. The basket system of claim 1 wherein the cover plate comprises mountings for mounting two or more upper screen deck frames, one above the other, to form a stack of screen deck frames above the lower screen deck frame.

8. The basket system of any one of claim 1 wherein the cover plate comprises one or more flanges projecting towards the front end of the basket to which a screen deck frame may be fitted with releasable fastenings.

9. The basket system of claim 8, wherein at least one flange of the cover plate projects towards the front end of the basket and is downwards directed, providing a downwards directed surface for releasable connection to a front edge of a screen deck frame.

10. The basket system of claim 8, wherein the feed receiving end of each upper screen deck frame, when fitted, is spaced by the one or more flanges so as to be further away from the fluid retaining wall than the screen deck frame below.

11. The basket system of claim 8, wherein cover plate support flanges are provides on the sides of the basket.

12. The basket system of claim 2 wherein the feed director is permanently fixed in place.

13. The basket system of claim 2 wherein the feed director is releasably attachable.

* * * * *